US007633037B2

(12) United States Patent
Hoffman

(10) Patent No.: US 7,633,037 B2
(45) Date of Patent: Dec. 15, 2009

(54) POSITIVE TEMPERATURE COEFFICIENT LIGHT EMITTING DIODE LIGHT

(75) Inventor: Peter F. Hoffman, Avon, OH (US)

(73) Assignee: Eveready Battery Co., Inc., St. Louis, MO (US)

( * ) Notice: Subject to any disclaimer, the term of this patent is extended or adjusted under 35 U.S.C. 154(b) by 192 days.

(21) Appl. No.: 11/612,886

(22) Filed: Dec. 19, 2006

(65) Prior Publication Data

US 2008/0143275 A1 Jun. 19, 2008

(51) Int. Cl.
*H05B 1/02* (2006.01)

(52) U.S. Cl. ..... 219/502; 219/505; 219/506; 362/183; 362/294

(58) Field of Classification Search ..... 219/494, 219/497, 501, 502, 504, 505, 507, 508; 362/253, 362/202, 192, 183, 294
See application file for complete search history.

(56) References Cited

U.S. PATENT DOCUMENTS

| | | | |
|---|---|---|---|
| 5,985,479 | A | 11/1999 | Boolish et al. |
| 2004/0257809 | A1 | 12/2004 | Wu |
| 2006/0012997 | A1 | 1/2006 | Catalano et al. |
| 2006/0039139 | A1 | 2/2006 | Maglica et al. |

FOREIGN PATENT DOCUMENTS

| | | | |
|---|---|---|---|
| EP | 0891120 | A | 1/1999 |
| GB | 2342434 | A | 4/2000 |
| JP | 2002151741 | A | 5/2002 |
| JP | 2006012622 | A | 1/2006 |

OTHER PUBLICATIONS

Kleinschmidt P., "Luminescence diodes with large voltage range owing to PCT resistor current regulation", Components Report, Siemens Aktiengesellscheft, Berlin, DE, vol. 10, No. 4, Oct. 1, 1975.
Patent Cooperation Treaty (PCT), International Search Report and Written Opinion for Application No. PCT/US2007/088122, filed Dec. 19, 2007, mailed Jun. 4, 2008, European Patent Office, Netherlands.
Lumileds Lighting, Thermal Management Considerations for SuperFlux LEDs, Application Brief AB20-4, Sep. 2002, pp. 1-14, www.lumileds.com.
Garry Petrie, The Perfect LED Light, 2004,15 pages, http://www.resurgentsoftware/perfect_led_light.html.
Dallas Semiconductors Maxim, Why Drive White LED's with Constant Current, Application Note 3256, Jun. 3, 2004, 7 pages. http://www.maxim-ic.com/an3256.
Joshua Israelsohn, A Thousand Points of Bright Turning Up the Volume on Solid-State Lighting, EDN, Jan. 6, 2005, www.edn.com.
Energizer, Energizer E91 Product Datasheet, published prior to download on Dec. 18, 2006, www.energizer.com.
Energizer, Energizer L91 Product Datasheet, published prior to download on Dec. 18, 2006, www.energizer.com.

*Primary Examiner*—Mark H Paschall
(74) *Attorney, Agent, or Firm*—Gregory J. Adams; Michael C. Pophal

(57) ABSTRACT

An apparatus includes electrical contacts coupled to a LED. The apparatus further includes a positive temperature coefficient resistor in operative thermal communication and electrically in series with the LED. A resistance of the PTC resistor varies as a function of a temperature of the LED.

7 Claims, 2 Drawing Sheets

POSITIVE TEMPERATURE COEFFICIENT LIGHT EMITTING DIODE LIGHT

BACKGROUND

The present application relates generally to lighting devices. While it finds particular application to lighting devices employing one or more light-emitting diodes (LED).

Light-emitting diodes (LEDs) have been used in various light devices. In one such application, a flashlight has included a plurality of batteries connected electrically in series with a fixed, current-limiting resistor, an LED, and a switch that opens and closes the circuit. With the circuit so configured, the diode forward current varies as a function of both the battery voltage and the diode forward voltage.

However, batteries are generally characterized by a sloping discharge curve, with their output voltage decreasing as the batteries discharge. While the value of the resistor can be selected to provide a desired diode forward current when the batteries are fully charged, the current will decrease as the batteries discharge, and energy that could otherwise be used to produce useful illumination is dissipated in the resistor. The value of the resistor can also be selected to provide the desired forward current at a point relatively lower on the discharge curve. While doing so tends to reduce the power dissipated in the resistor, the diode forward current will be greater than desired when the batteries are more fully charged. Such an approach is likewise relatively inefficient, and can result in greater than desired diode power dissipation.

According to another approach, a switching regulator circuit configured as a current regulator has been used to drive one or more LEDs at a substantially constant forward current. While such an approach can provide improved current regulation compared to the use of a fixed current-limiting resistor, it also tends to be relatively expensive, and the switching regulator circuit and its associated circuitry can be bulky. Moreover, losses in the switching regulator circuit can have a deleterious effect on the overall efficiency.

SUMMARY

Aspects of the present application address these matters, and others.

In one aspect, an apparatus includes electrical contacts coupled to a LED. The apparatus further includes a positive temperature coefficient resistor in operative thermal communication and electrically in series with the LED. A resistance of the PTC resistor varies as a function of a temperature of the LED.

In another aspect, an apparatus includes a power receiving region, at least one LED, and a temperature-based, closed-loop controller that varies in resistance as a temperature of the at least one LED varies.

In another aspect, a method includes applying a forward current to a LED, whereby the forward current causes the LED to heat, sensing a temperature of the LED, and using the sensed temperature to vary a resistance of a positive temperature coefficient (PTC) resistor electrically in series with the LED to reduce the fluctuations in the forward current.

In another aspect, an apparatus includes a means for receiving power used to energize an LED and a means in operative thermal communication and electrically in series with the LED for reducing forward current variations of a forward current of the LED based on a temperature of the LED.

Those skilled in the art will recognize still other aspects of the present application upon reading and understanding the attached description.

BRIEF DESCRIPTION OF THE DRAWINGS

The present application is illustrated by way of example and not limitation in the figures of the accompanying drawings, in which like references indicate similar elements and in which.

DETAILED DESCRIPTION

Figure 1:
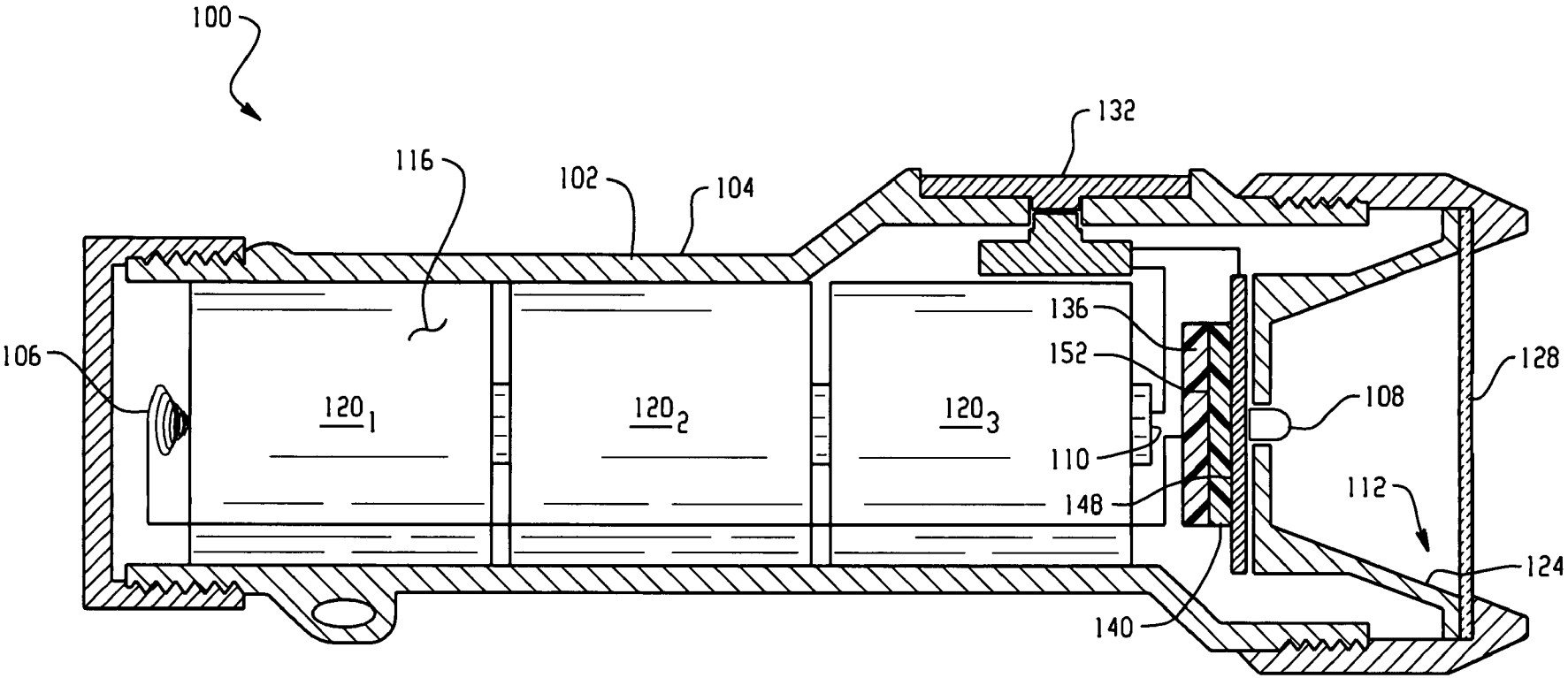
FIG. 1 is a cross-sectional view of a light emitting diode (LED) light device.

FIG. 1 depicts an exemplary battery powered light 100. As illustrated, the light 100 is configured as a handheld flashlight having a generally cylindrical housing 104, one or more LEDs 108, and a light management system 112. The housing 104 defines a battery-receiving region 116, which includes first and second electrical contacts 106, 110 and receives first $\mathbf{120}_1$, second $\mathbf{120}_2$, and third $\mathbf{120}_3$ generally cylindrical batteries. The light management system 112 includes a generally parabolic reflector 124 and a lens 128 that cooperate to direct light generated by the light source 108 so as to form a generally unidirectional light beam. A user operated switch 132 allows the user to control the operation of the light 100.

Figure 2:
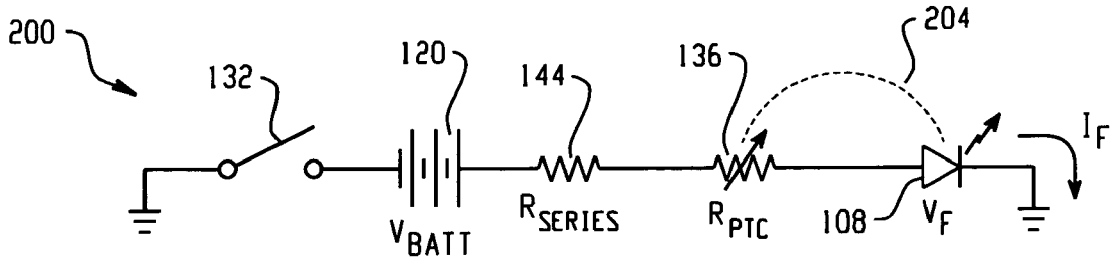
FIG. 2 is a schematic diagram of an electric circuit.

With ongoing reference to FIG. 1, the light 100 also includes a positive temperature coefficient (PTC) resistive element 136, a thermally conductive substrate 140, and an optional series resistor 144 (see FIG. 2). A first major surface 148 of the substrate 140 is mounted for thermal communication with the LED 108, while a second major surface 152 of the substrate 140 is mounted for thermal communication with the PTC resistive element 136. Consequently, the PTC resistive element 136 is in operative thermal communication with the LED 108 so that changes in the temperature of the LED 108 cause a change in the resistance of the PTC resistive element 136.

In one implementation, the batteries 120 are C-size, D-size, or other batteries that each produce a nominal open circuit voltage of approximately 1.5 volts direct current (VDC). The LED 108 is a single 1 Watt (W) white LED having a nominal forward voltage threshold of approximately 3.4 VDC (with specification limits typically ranging from roughly 3 to 4 VDC) and a nominal forward current rating of about 350 milliamperes (mA).

The substrate 140 is fabricated from a thermally conductive material such as aluminum, copper, or the like. It should also be noted that, depending on the construction and characteristics of the LED 108, the substrate 140 may also function as a heat sink that dissipates thermal energy generated by LED 108. The substrate 140 may also be omitted.

An optional insulator may also be provided to reduce the influence of ambient temperature on the PTC resistive element 136. Such insulator may be positioned next to and in relatively close proximity with one or more of the surfaces of the PTC resistive element 136, which are not in thermal communication with the substrate 140.

Turning now to FIG. 2, the switch 132, batteries 120, resistor 144, PTC resistive element 136, and LED 108 are connected electrically in series in a circuit 200. The thermal relationship between the LED 108 and the PTC resistive element 136 is indicated by the dashed line 204.

The forward current $1_F$ through the LED 108 can be expressed as follows:

Equation 1:

$$I_F = \frac{V_{Batt} - V_F}{R_{Series} + R_{PTC}},$$

where $V_{Batt}$ is the voltage produced by the batteries 120, $V_F$ is the forward voltage of the LED 108, $R_{series}$ is the resistance of the resistor 144, and $R_{PTC}$ is the resistance of the PTC resistive element 136.

As can be seen from Equation 1, the forward current $1_F$ and hence the LED 108 power dissipation are a function of the battery voltage $V_{Batt}$ and the diode forward voltage $V_F$. As the temperature of the LED 108 is a function of its power dissipation, its temperature tends to decrease as the batteries discharge. Because the PTC resistive element 136 is in operative thermal communication with the LED 108, the resistance of the PTC resistive element 136 likewise decreases, thus tending to increase the forward current $I_F$. Thus, the circuit can be viewed as acting a temperature-based closed-loop controller that tends to reduce or otherwise compensate for changes in diode forward current $1_F$ that would otherwise occur as the batteries discharge. The circuit 200 similarly compensates for changes in the diode forward voltage $V_F$, as may occur, for example as the LED temperature changes or due to piece-to-piece or lot-to-lot variations in the LEDs.

Suitable values of $R_{Series}$ and $R_{PTC}$ in one example, can be determined according to the electrical and thermal characteristics of a particular light 100, the desired efficiency, and similar factors. For instance, $R_{Series}$ and $R_{PTC}$ may be chosen to drive the LED 108 at about its maximum rated current level to maximize the brightness of the emitted light. In another instance, $R_{Series}$ and $R_{PTC}$ may be chosen to drive the LED 108 at a lower forward current to relatively improve efficiency and extend the life of the batteries 120, although the nominal light output will be dimmer. In one such implementation, the nominal forward current is established at or near the LED's maximum luminous efficiency.

In one example embodiment, the PTC resistive element 136 is a polymeric PTC (PPTC) device. Such devices are also sometimes referred to as thermally resettable fuses, thermostats, or non-linear thermistors. A PPTC device generally includes a matrix of crystalline organic polymer with dispersed conductive carbon black particles. These particles change their physical properties as a function of temperature, which changes their electrical properties to be less or more electrically conductive. By way of example, if the current passing through the PPTC device exceeds an electrical current threshold, the PPTC device heats and expands, which causes the carbon particles to separate, breaking conductive pathways and, thus, causing the resistance of the device to increase. As the PPTC device cools, it contracts and its resistance decreases.

A non-limiting example of a suitable PTC device is discussed in U.S. Pat. No. 5,985,479 to Boolish, et al. (filed Nov. 14, 1997), which is incorporated herein by reference.

By employing the PTC element 136 as described herein, variations in the LED forward current can be reduced for a relatively wide range of supply voltages. By way of example, the PTC element 136 is especially well-suited for applications utilizing 1.5 VDC alkaline batteries (e.g., $Zn/MnO_2$) or other battery chemistries with similar voltage discharge properties. The voltage discharge curve of such batteries is generally characterized as non-linear with a relatively rapid and steep drop off, which tends to be relatively steeper when the batteries are fully charge or discharged, and the slope of the curve increases as the current is increased. Using the PTC element 136 to reduce forward current variations or fluctuations as described herein with such batteries can be used to provide a relatively more constant light output relative to a configuration without the PTC element 136 in which the light output follows and dims with the discharging voltage of the batteries.

The battery voltage range may also be due to using different battery chemistries. For example, Carbon Zinc (CZn), lithium iron disulfide ($LiFeS_2$), alkaline (zinc-manganese dioxide), nickel-cadmium (NiCd), and nickel metal hydride (NiMH) chemistries are generally physically interchangeable. However, CZn, $LiFeS_2$ and alkaline chemistries have a nominal open circuit voltage of about 1.5 VDC, whereas NiCd and NiMH have a nominal open circuit voltage of about 1.2 VDC. Thus, using three alkaline batteries provides an aggregate nominal open circuit voltage of 4.5 VDC, whereas using three NiMH batteries provides an aggregate nominal open circuit voltage of 3.6 VDC. Without the PTC element 136, these voltage differences may result in relatively large forward current differences, depending on the battery chemistry. However, the PTC element 136 can be used to compensate for these voltage differences as described above, thus tending to reduce performance variations that may result from the use of batteries having different chemistries. In addition, $R_{Series}$ and $R_{PTC}$ can be selected to accommodate a range of battery voltages.

Variations are also contemplated.

While the above discussion has focused on a light 100 having three batteries, other battery configurations are contemplated herein. For instance, the battery-receiving region 116 may be alternatively configured to accept only a single battery 120, two batteries 120, or more than three batteries 120. In one example, the light 100 is configured to accept two (2) AA size batteries, and the one or more LEDs 108 includes three (3) 72 milliwatt (mW) LEDs.

The battery-receiving region 116 may also be configured to receive lithium-ion (Li Ion) or other battery chemistries. Thus, in addition to receiving batteries having a nominal open circuit voltage of 1.2 VDC and 1.5 VDC as noted above, the light 100 receives batteries having nominal open circuit voltages of 1.8 VDC or 3.6 VDC, as well as other voltages.

Other wattages of LEDs may also be provided, as may colors other than white. Examples of suitable colors include cyan, green, amber, red-orange, and red.

Suitable LEDs also include LEDs that emit radiation having a wavelength outside of the visible light portion of the electromagnetic spectrum, including radiation having wavelengths within the infrared (IR) and ultraviolet (UV) portion of the electromagnetic spectrum.

Two or more of the LEDs may also be connected electrically in series or parallel. In one implementation, two or more LEDs are mounted to the same substrate, and the substrate is thermally coupled to a single PTC resistive element 136 as described herein. In another instance, each of a plurality of LEDs is mounted to its own corresponding substrate. With this configuration, a single PTC element 136 may be thermally coupled with only one of the LEDs 108 as described above so that the PTC element 136 responds to temperature changes in the thermally coupled LED 108 or a different PTC element 136 may be thermally coupled to each of the LEDs 108 as described herein so that each PTC element 136 responds to a corresponding one of the LEDs 108.

The light 100 may also include more than one independently controllable LED 108, batteries 120, and/or circuits 200. For example, one LED 108 may provide a light beam while another serves as an area light.

The illustrated embodiment is discussed with respect to a flashlight emitting a unidirectional light beam. However, the light 100 may also be configured otherwise, for example, as an area light, a lantern or a headlamp. The light 100 may also include one or more flat surfaces which facilitate placement thereof on surface. It may also include suitable clamps, brackets, cut and loop fasteners, magnets, or other fasteners for selectively attaching the light device 100 to an object.

Figure 3:
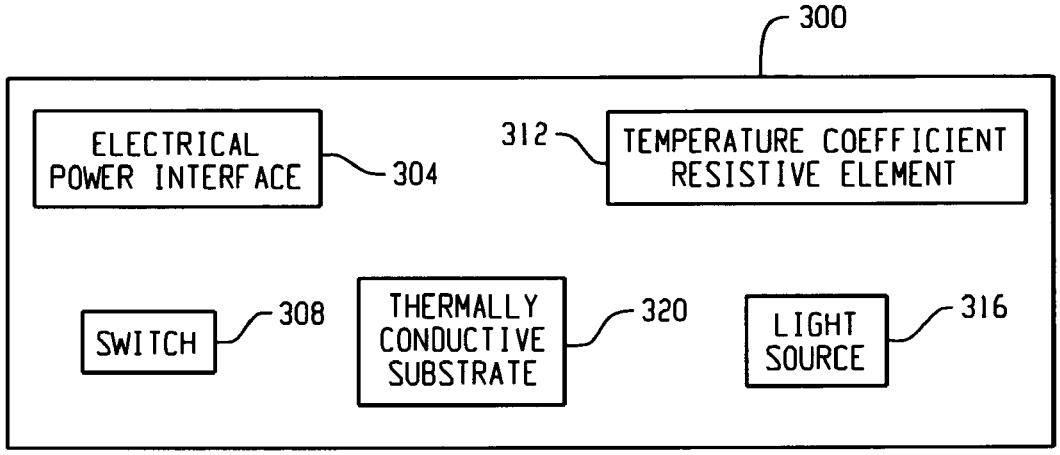
FIG. 3 depicts a block diagram of an exemplary light device.

FIG. 3 depicts a block diagram of an exemplary light 300 having an electrical power interface 304, a switch 308, a positive temperature coefficient resistive element 312 such as the PTC resistive element 136, and a light source 316 such as the one or more LEDs 108. Power for energizing the light source 316 is received via the electrical power interface 304, which may receive power from various power sources including but not limited to a battery source, an alternating current source, an external power source. The switch 308 is used to open or close an electrically conductive path electrically connecting the electrical power source 304 and the light source 316.

The positive temperature coefficient resistive element 312 is in operative thermal communication with the light source 316, and the resistance of the positive temperature coefficient resistive element 312 changes as a function of the temperature of the light source 316. In one instance, the positive temperature coefficient resistive element 312 is configured so that its resistance changes in a manner so as to reduce variations in the current flowing through the light source 308 for a relatively wide range of supply and light source 316 voltages. Optionally, a thermally conductive substrate 320 such as the thermally conductive substrate 140 is disposed between and in thermal communication with the temperature coefficient element 312 and the light source 316.

The lights 100 and 300 can be used in various light applications. For example, the light 300 may be used as a domestic, industrial, or commercial lights, including but not limited to a flashlight, a floor lamp, a head lamp, a desk lamp, an interior light, an exterior light, an automotive vehicle light, a safety lamp, an under the counter light, a recessed light, as well as other lights. In addition, the lights 100 and 300 may be included in hand-held devices such mobile phones, personal data assistants (PDAs), gaming systems, and the like, and other applications such as motor vehicles (having a 12 VDC battery), domestic appliances, and industrial appliances.

The PTC element 136 can similarly be employed in applications that receive power from power sources other than batteries. In such applications, the PTC element 136 can be used as described herein to compensate for voltage ranges and variations in such power sources and LED forward voltage variations when using such voltage sources.

Figure 4:
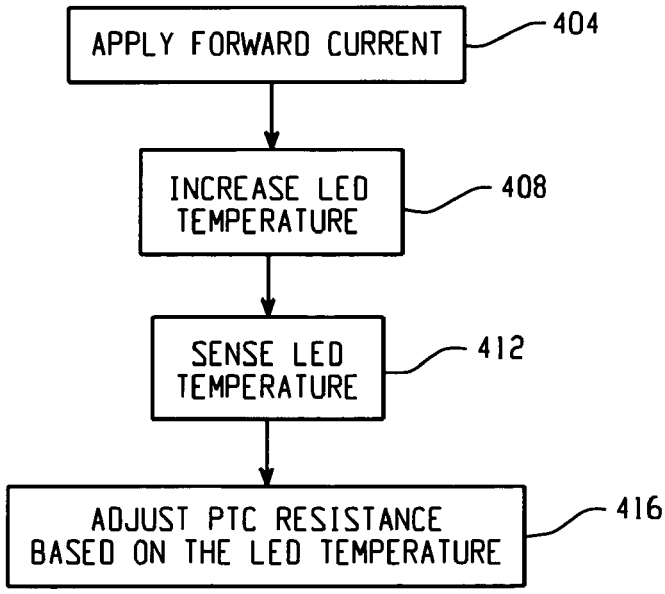
FIG. 4 depicts a method of operating the LED light device.

Operation of the lights 100 and 300 is now described in relation to FIG. 4.

At 404, a forward current is supplied to the light LED.

At 408, the forward current causes the LED to heat.

At 412, the temperature of the LED is sensed.

At 416, the sensed temperature varies a resistance of a positive temperature coefficient (PTC) resistor electrically in series with the LED so as to reduce variations in the forward current supplied to the LED.

The invention has been described with reference to the preferred embodiments. Of course, modifications and alterations will occur to others upon reading and understanding the preceding description. It is intended that the invention be construed as including all such modifications and alterations insofar as they come within the scope of the appended claims and the equivalents thereof.

What is claimed is:

1. An apparatus comprising:

at least one LED powered by a non-linear electrical power having power fluctuations;

a substrate comprised of a thermally conductive material, wherein the at least one LED is mounted to a first surface of the substrate;

a temperature-based controller mounted to a second surface of the substrate and electrically coupled to the at least one LED that mitigates the power fluctuations of the non-linear electrical power to cause the LED to provide a relatively constant light output; and an insulator proximate to surfaces of the temperature-based controller that reduces the influence of ambient temperature on the temperature-based controller.

2. The apparatus of claim 1, further including a battery receiving region that receives a battery that provides the electrical power for the LED.

3. The apparatus of claim 1, wherein an increase in the resistance of the temperature coefficient resistor decreases a forward current of the LED.

4. The apparatus of claim 1, wherein the temperature-based controller is a polymeric positive temperature coefficient (PPTC) resistor.

5. The apparatus of claim 1, further including a battery receiving region that selectively receives one of a primary and a secondary battery that provide power for illuminating the LED.

6. The apparatus of claim 1, wherein the LED is a white LED.

7. The apparatus of claim 1, wherein the apparatus is a domestic lamp.

* * * * *